United States Patent [19]

Baumann

[11] 4,375,105

[45] Feb. 22, 1983

[54] X-RAY DIAGNOSTIC GENERATOR

[75] Inventor: Heinz Baumann, Erlangen-Buckenhof, Fed. Rep. of Germany

[73] Assignee: Siemens Aktiengesellschaft, Berlin & Munich, Fed. Rep. of Germany

[21] Appl. No.: 182,689

[22] Filed: Aug. 29, 1980

Related U.S. Application Data

[63] Continuation-in-part of Ser. No. 960,861, Nov. 15, 1978.

[30] Foreign Application Priority Data

Jan. 20, 1978 [DE] Fed. Rep. of Germany ... 7801673[U]

[51] Int. Cl.[3] ..... H05G 1/02; H05G 1/32

[52] U.S. Cl. ..... 378/092; 378/112

[58] Field of Search ..... 250/419, 421, 403; 378/92, 112

[56] References Cited

U.S. PATENT DOCUMENTS

| | | | |
|---|---|---|---|
| 2,137,647 | 11/1938 | Graves | 250/421 |
| 3,256,439 | 6/1966 | Dyke et al. | 250/402 |
| 3,676,683 | 7/1972 | Vordervelden | 250/421 |
| 3,878,394 | 4/1975 | Golden | 250/402 |

FOREIGN PATENT DOCUMENTS

| | | |
|---|---|---|
| 2031108 | 12/1971 | Fed. Rep. of Germany . |
| 2204453 | 8/1973 | Fed. Rep. of Germany . |

*Primary Examiner*—Alfred E. Smith
*Assistant Examiner*—T. N. Grigsby
*Attorney, Agent, or Firm*—Hill, Van Santen, Steadman, Chiara & Simpson

[57] ABSTRACT

An X-ray diagnostic generator has a high voltage means to supply energy to an x-ray tube and a high voltage regulating means housed in a common oil-filled tank.

2 Claims, 4 Drawing Figures

X-RAY DIAGNOSTIC GENERATOR

CROSS-REFERENCE TO RELATED APPLICATION

This application is a continuation-in-part of my earlier filed application, U.S. Ser. No. 960,861, filed Nov. 15, 1978, and assigned to the same assignee as the present invention.

BACKGROUND OF THE INVENTION

1. Field of the Invention

The invention relates to an x-ray diagnostic generator comprising an x-ray tube, a high voltage generator to supply the x-ray tube and a regulating part arranged on the high voltage side, in which the high voltage generator and the regulating part are housed in an oil-filled tank.

The regulating part in an x-ray diagnostic generator of this type can consist of one or a plurality of control tubes which are connected in series with the x-ray tube and whose grid voltage is adjusted in such a manner that the desired x-ray tube voltage is present at the x-ray tube. The regulating part can also serve to engage and disengage the x-ray tube.

2. The Prior Art

It is known to provide separate tanks for the regulating part and the high voltage transformer, which tanks are connected to one another via high voltage cable.

SUMMARY OF THE INVENTION

The object of the invention is, vis-a-vis the state of the art, to significantly simplify and reduce in price an x-ray diagnostic generator of the type initially cited.

This object is inventively achieved in that the high voltage generator is arranged between sections of a regulating part. In this design of an x-ray diagnostic generator, a high voltage cable between high voltage generator and regulating part is eliminated. A simplification is also produced because only a single tank is provided, and it is not necessary to have a ground shield between sections of the regulating part.

DETAILED DESCRIPTION

Figure 1:
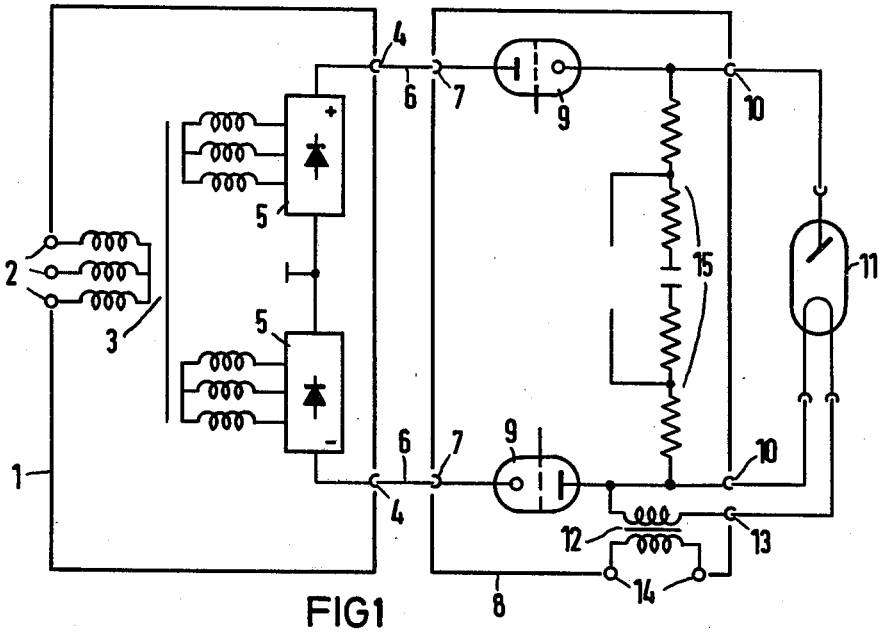
FIG. 1 shows a known x-ray diagnostic generator by means of a diagrammatic view.

In FIG. 1, an x-ray diagnostic generator of a known type is illustrated. It includes an oil-filled tank 1, on which connections 2 of a high voltage transformer 3 for connection to the three-phase network, and high voltage connections 4 are conducted to the outside. In the tank 1, beyond the high voltage transformer, two high voltage rectifiers 5 connected in series are also arranged, which rectifiers are connected to the secondary windings of the high voltage transformer 3, and whose positive and negative poles respectively are conducted to the connections 4. The connections 4 are connected via high voltage cable 6 with high voltage connections 7 on a second oil-filled tank 8, which connections 7 lead to two switch and control tubes 9 for the high voltage. The switch and control tubes lie in series with an x-ray tube 11 which is connected at the high voltage connections 10. In tank 8, further, a filament transformer 12 is arranged, which conducts the filament voltage to the x-ray tube 11 via one of the high voltage connections 10 and a filament voltage connection 13. The primary energy is supplied to the filament transformer 12 via connections 14. For the control of the high voltage at the x-ray tube 11, an actual value generator 15 for producing a signal that corresponds to the actual x-ray tube voltage is also arranged in the tank 8. The control grids of the control tubes 9 and the connections of the actual value generator 15 are also conducted to the outside of the tank 8, in a manner not illustrated.

Disadvantageous in the known x-ray diagnostic generator illustrated in FIG. 1, is that, because of two oil-filled tanks 1, 8 and in particular also because of the necessity of a high voltage cable 6 between the two tanks 1 and 8, the expense for the high voltage side of the x-ray diagnostic generator is relatively high.

Figure 2:
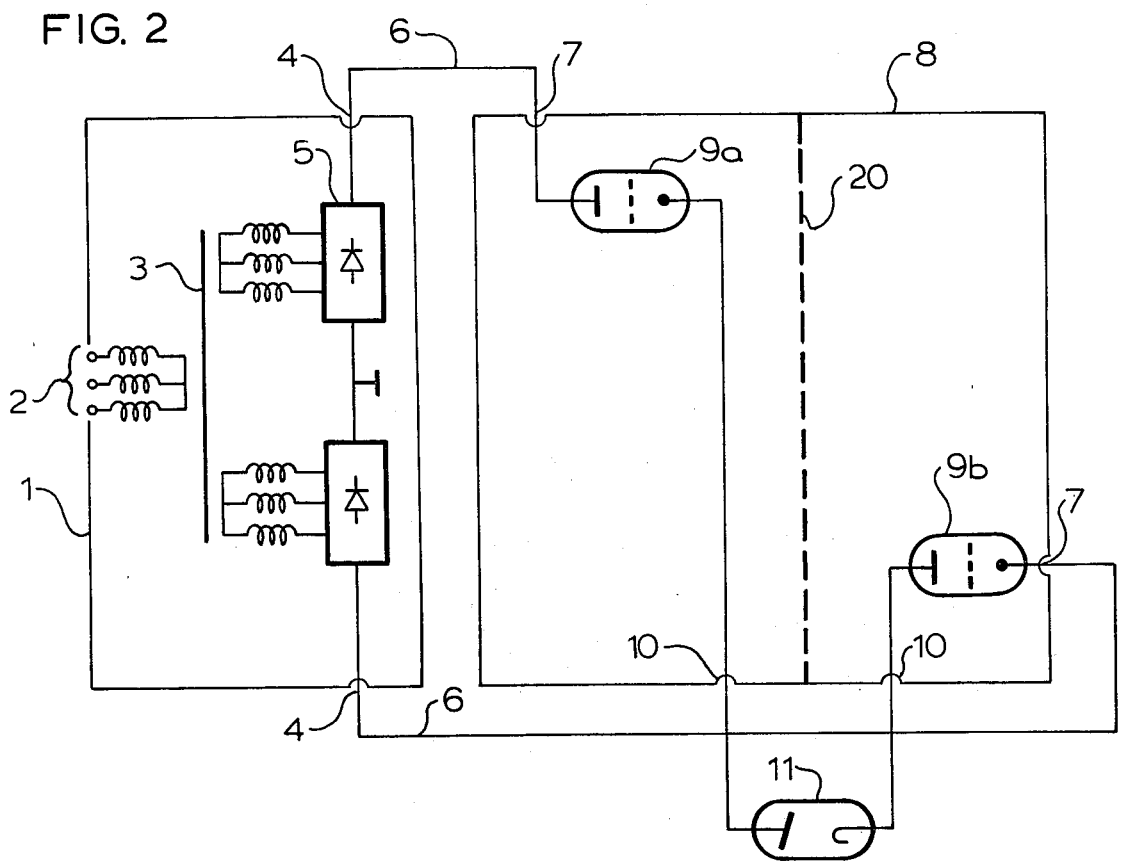
FIG. 2 is a diagrammatic view of a second known x-ray diagnostic generator.

FIG. 2 also shows a known x-ray diagnostic generator. In FIG. 2, elements common to FIG. 1 are given the same numeric designation. In FIG. 2, a grounded metal plate 20 is positioned between the two control means or tubes *9a, 9b*. The grounded plate 20 electrically isolates the high voltage control means or tubes *9a* and *9b* from one another.

Figure 3:
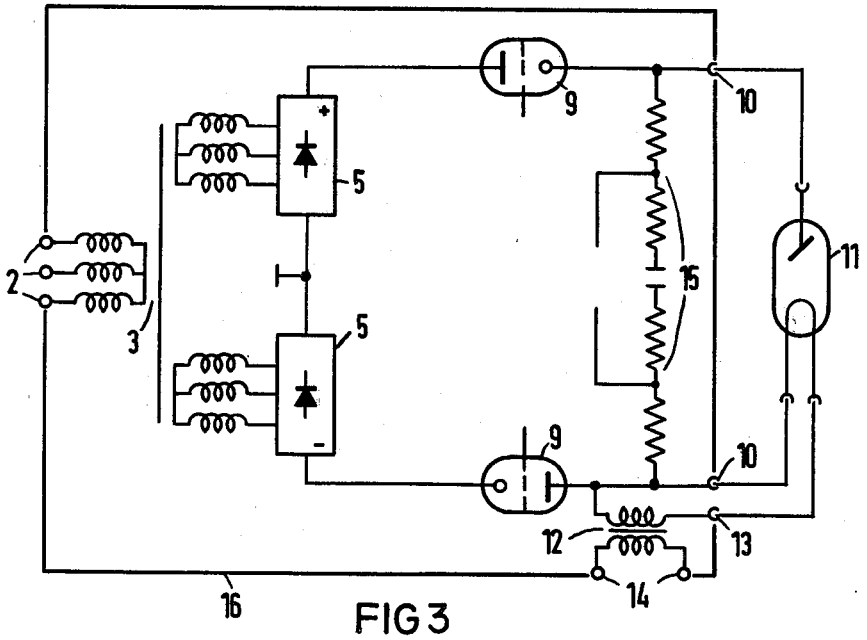
FIG. 3 is a diagrammatic illustration of an exemplary embodiment in accordance with the present invention.

In FIG. 3, component parts that are the same as component parts of FIG. 1 are referred to with the same reference numbers. It follows, that the high voltage generator consisting of the high voltage transformer 3 and the high voltage rectifier 5 is housed in a common oil-filled tank 16 together with the control tubes 9, the actual value generator 15 and the filament transformer 12. In FIGS. 1 and 3, the regulator connected to the actual value generator 15 and to the grids of the control tubes 9 is not illustrated for the sake of clarity. It is disposed in an electronics cabinet outside of the tank 8 or 16, respectively.

Figure 4:
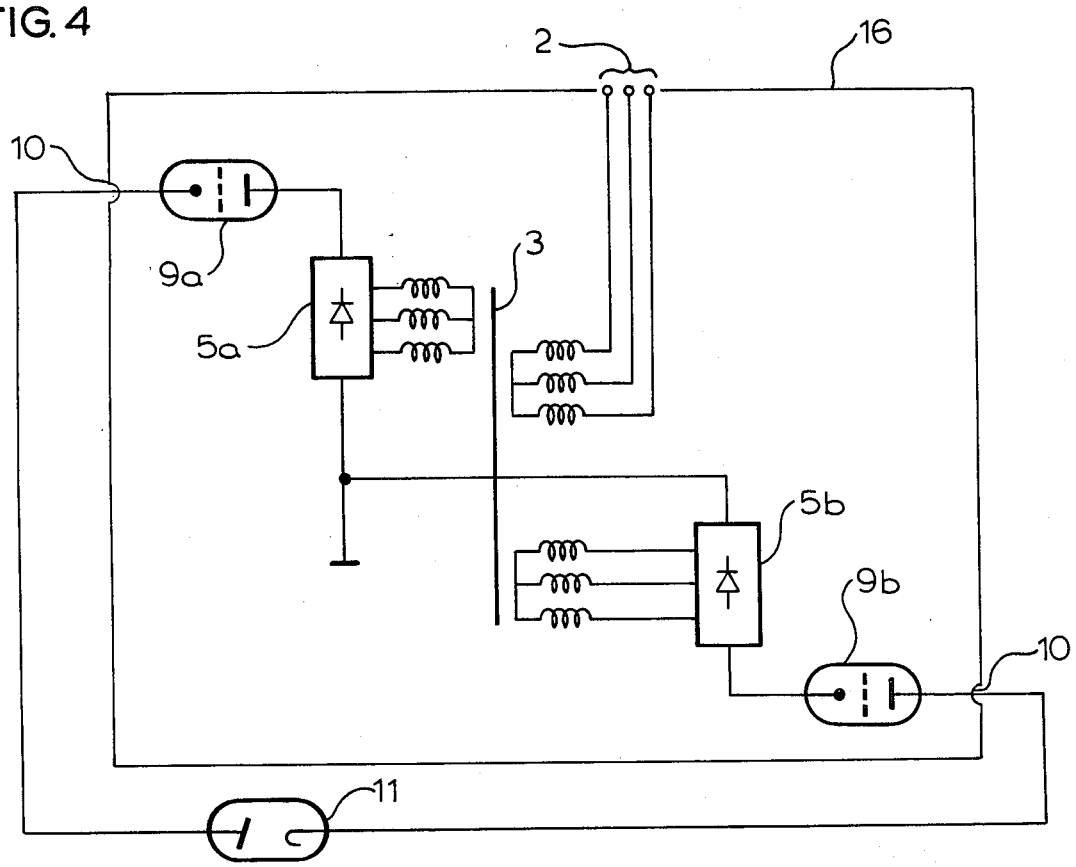
FIG. 4 is a diagrammatic illustration of the exemplary embodiment of FIG. 3 showing the physical relationship between the control tubes and the transformer.

In FIG. 4 the physical relationship between the control tubes *9a, 9b* and transformer 3 is shown. In FIG. 4, the high voltage transformer 3 and the rectifiers or rectifier means *5a, 5b* are positioned between the control means or tubes *9a, 9b* in the single oil-filled tank or housing 16. The high voltage transformer 3 thus separates the potentials on the control tubes *9a, 9b*. Thus, due to the positioniing of the transformer 3 between the control means or tubes *9a, 9b*, a very reliable, less expensive, single tank x-ray diagnostic generator may be formed without incorporating the shielding plate 20.

In the x-ray diagnostic generator of FIG. 4, it will be understood that the cathode of tube 11 could be heated by a low voltage isolation transformer such as transformer 12 of FIGS. 1 and 3.

Within the framework of the invention, any one of a plurality of x-ray tubes is connectable at the output of the regulating part via high voltage switches at any given time.

It may be apparent that many modifications and variations may be effected without departing from the scope of the novel concepts and teachings of the present invention.

The housing of the transformer 3 in FIG. 4 should be connected to ground.

I claim as my invention:

1. In an X-ray diagnostic generator suitable for use with a plurality of externally located X-ray tubes, having a high voltage step-up transformer with a secondary connected to high voltage means for rectification, an improvement comprising:

a single, oil filled, closed housing having AC input connection means connected to a primary of the high voltage step-up transformer, output high voltage connection means adapted to be switchably connected to the plurality of X-ray tubes to supply high voltage between an anode and a cathode of a selected X-ray tube, and first and second high voltage control means responsive to external control via control leads, each of said control means being connected between a rectified output of a corresponding one of the high voltage means for rectification and a corresponding section of said output high voltage connection means, each of said high voltage control means being adapted to regulate the output high voltage, and said high voltage step-up transformer being positioned and of sufficient dimensions to provide electrical shielding, said high voltage step-up transformer being positioned between said first and second control means to provide electrical shielding therebetween.

2. The improved x-ray diagnostic generator according to claim 1 wherein:

said high voltage step-up transformer comprises a three-phase step-up transformer.

* * * * *